US007024726B1

(12) United States Patent
Cornell

(10) Patent No.: US 7,024,726 B1
(45) Date of Patent: Apr. 11, 2006

(54) ROTATING DOOR STOP AND METHOD OF USE

(76) Inventor: Trace D. Cornell, 8251 Springridge Rd., Bainbridge Island, WA (US) 98110

( * ) Notice: Subject to any disclaimer, the term of this patent is extended or adjusted under 35 U.S.C. 154(b) by 47 days.

(21) Appl. No.: 10/795,562

(22) Filed: Mar. 6, 2004

(51) Int. Cl.
*E05F 5/02* (2006.01)

(52) U.S. Cl. ..... 16/82; 292/340; 292/DIG. 15

(58) Field of Classification Search ..... 16/82, 16/85, 86 R, 86 A, 86 B; 292/340, 203, 292/251.5, DIG. 15, DIG. 19
See application file for complete search history.

(56) References Cited

U.S. PATENT DOCUMENTS

| | | | | | |
|---|---|---|---|---|---|
| 1,693,158 | A | * | 11/1928 | Reinicke et al. | 292/60 |
| 2,116,444 | A | * | 5/1938 | Maier | 292/17 |
| 2,230,598 | A | * | 2/1941 | Mason | 292/70 |
| 2,454,414 | A | * | 11/1948 | Taylor | 292/70 |
| 3,160,912 | A | * | 12/1964 | Heyer | 16/85 |
| 3,994,043 | A | * | 11/1976 | Gurzenda | 16/86 A |
| 4,082,351 | A | * | 4/1978 | Chrones | 292/347 |
| 4,218,807 | A | * | 8/1980 | Snow | 16/86 A |
| 5,517,721 | A | * | 5/1996 | Roth et al. | 16/86 R |
| 5,575,514 | A | * | 11/1996 | Troy | 292/340 |
| 6,295,697 | B1 | * | 10/2001 | Simon | 16/86 R |
| 6,629,335 | B1 | * | 10/2003 | Derman | 16/85 |

FOREIGN PATENT DOCUMENTS

| | | | | |
|---|---|---|---|---|
| DE | 29618531 | U1 | * | 12/1996 |
| GB | 2075117 | A | * | 11/1981 |
| JP | 2000064694 | A | * | 2/2000 |
| JP | 2002168042 | A | * | 6/2002 |

* cited by examiner

*Primary Examiner*—Chuck Y. Mah
(74) *Attorney, Agent, or Firm*—Ted Masters

(57) ABSTRACT

A rotating door stop includes a base member which is mounted to a baseboard or other structure. A stop member is connected to the base member so that the stop member freely rotates about its longitudinal axis with respect to the base member. Because the stop member rotates, it cannot be grasped and unscrewed by a child.

17 Claims, 4 Drawing Sheets

Fig. 3
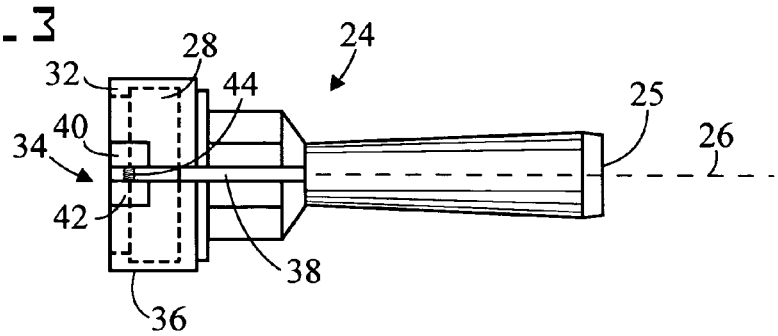
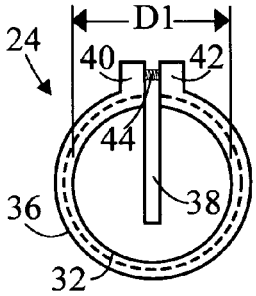
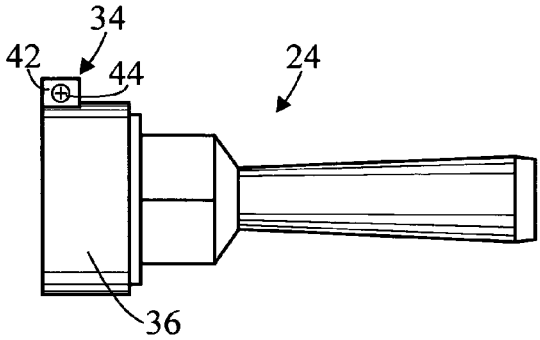
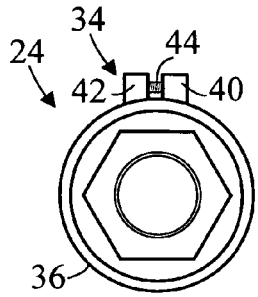
Fig. 5 Fig. 4 Fig. 6
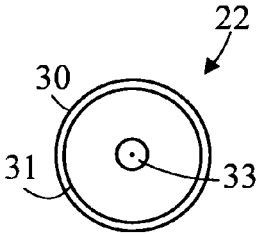
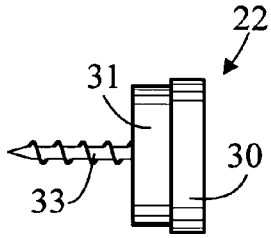
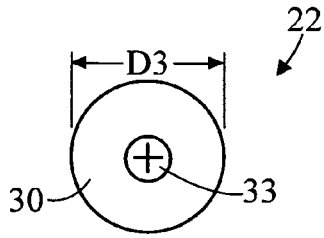
Fig. 8 Fig. 7 Fig. 9

Fig. 10
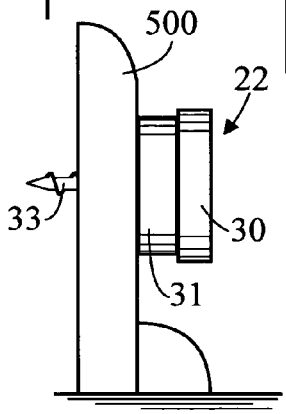
Fig. 11
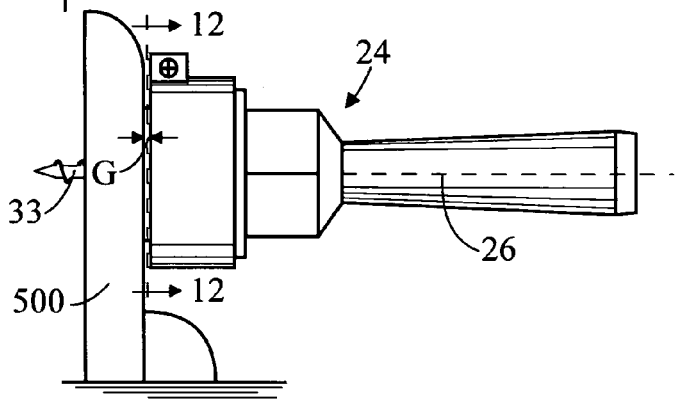
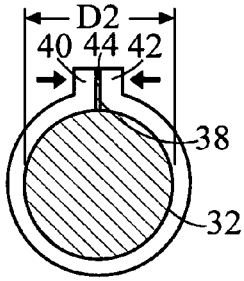
Fig. 12
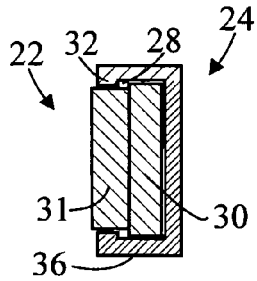
Fig. 13
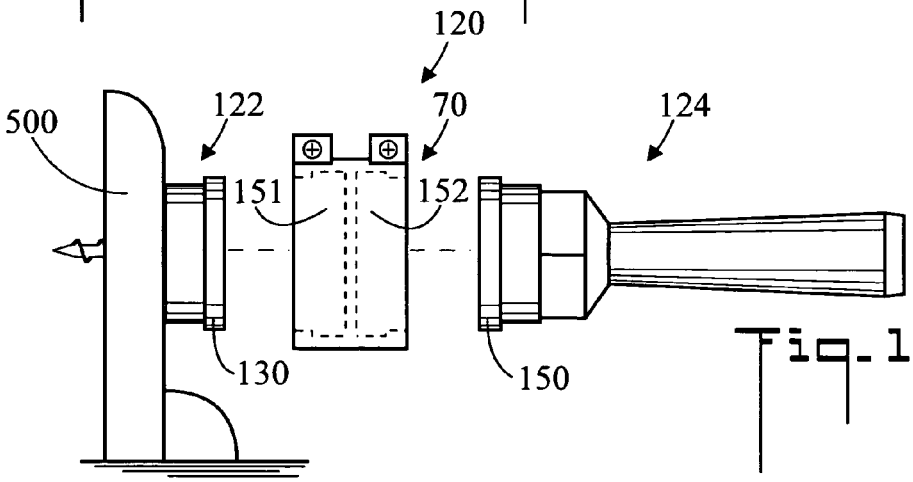
Fig. 14

ROTATING DOOR STOP AND METHOD OF USE

TECHNICAL FIELD

The present invention pertains generally to doors, and more particularly to a door stop which when installed rotates about its longitudinal axis and therefore cannot be removed by a child.

BACKGROUND OF THE INVENTION

Door stops are attached to a baseboard or other structure to limit the travel of a door when the door is opened. The door stops are typically screwed into the baseboard using an attached projecting screw. A problem exists however in that children can unscrew and remove the door stop and possible injury themselves with the projecting sharp screw. The present invention solves this problem.

BRIEF SUMMARY OF THE INVENTION

The present invention is directed to a rotating child-safe door stop which cannot be removed by a child. When the door stop is installed, the shaft of the door stop spins about the base, making it impossible to unscrew the door stop from the baseboard without a screw driver. As such, a child cannot unscrew the door stop and be injured by the projecting screw.

In accordance with a preferred embodiment of the invention, a door stop includes a base member and a stop member having a longitudinal axis. The stop member is connected to the base member so that the stop member may freely rotate with respect to the base member about its longitudinal axis.

In accordance with an aspect of the invention, the base member has a disk. The stop member has (1) a cavity shaped and dimensioned to receive the disk of the base member, (2) a lip for selectively capturing the disk, and (3) a compression mechanism for selectively placing the lip in an expanded state or a compressed state. With the lip in the expanded state the disk may be passed though the lip and received by the cavity. The compression mechanism may then be utilized to place the lip in the compressed state wherein the disk is captured by the lip and held within the cavity thereby rotatably connecting the stop member to the base member.

In accordance with another aspect of the invention, when in the expanded state the lip has a first diameter, when in the compressed state the lip has a second diameter less than the first diameter, and the disk has a third diameter, wherein the third diameter is less than the first diameter and greater than the second diameter.

In accordance with another aspect of the invention, the compression mechanism includes (1) a sleeve which forms the cavity and the lip, the sleeve having a slot, (2) first and second bosses disposed on the sleeve on opposite sides of the slot, and (3) an adjustment screw connecting the first and second bosses, wherein by turning the adjustment screw the bosses may be brought closer together or further apart thereby compressing or expanding the lip.

In accordance with another aspect of the invention, the base member includes a mounting screw for attaching the base member to a baseboard.

In accordance with another aspect of the invention, when the stop member is connected to the base member, a gap exists between the stop member and the baseboard.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 3 is a top plan view of a stop member of the door stop;

FIG. 4 is a side elevation view of the stop member;

FIG. 5 is an end elevation view of the stop member;

FIG. 6 is an opposite end elevation view of the stop member;

FIG. 7 is a side elevation view of a base member of the door stop;

FIG. 8 is an end elevation view of the base member;

FIG. 9 is an opposite end elevation view of the base member;

FIG. 10 is a side elevation view of the base member installed on a baseboard;

FIG. 11 is a side elevation view of the stop member installed on the base member;

FIG. 12 is a cross sectional view along the line 12—12 of FIG. 11;

FIG. 13 is a partial cross sectional view showing how the base member is rotationally received by the stop member;

FIG. 14 is an exploded side elevation view of a second embodiment of the door stop;

DETAILED DESCRIPTION OF THE INVENTION

Figure 1:
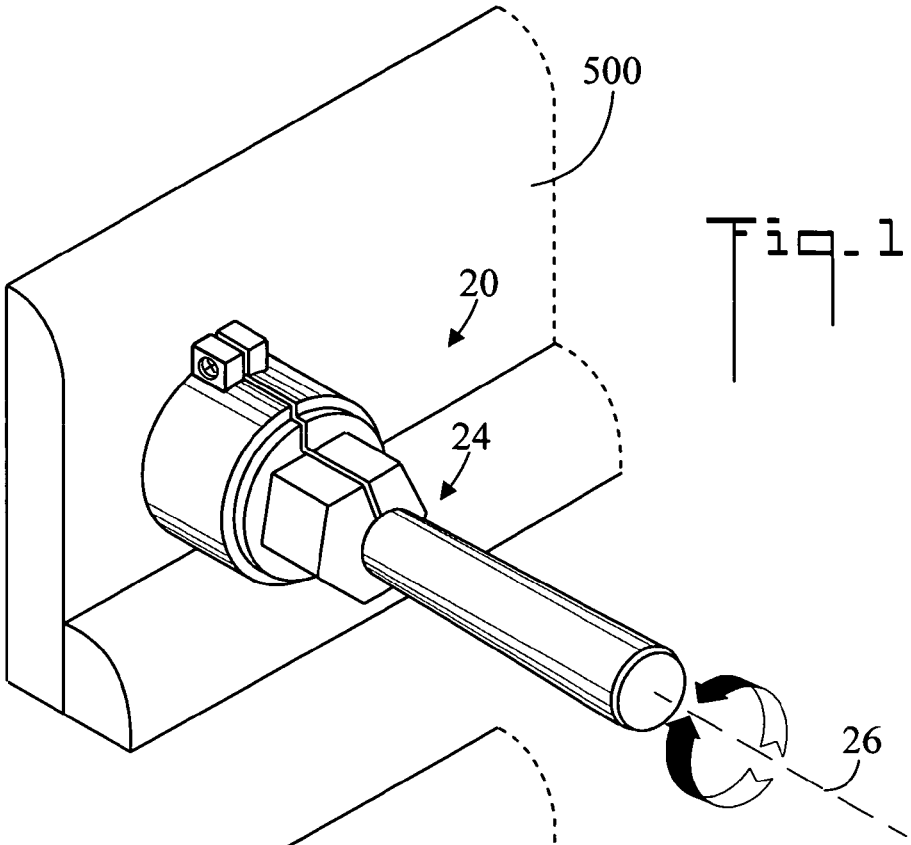
FIG. 1 is a perspective view of a door stop in accordance with the present invention installed on a baseboard.
Figure 2:
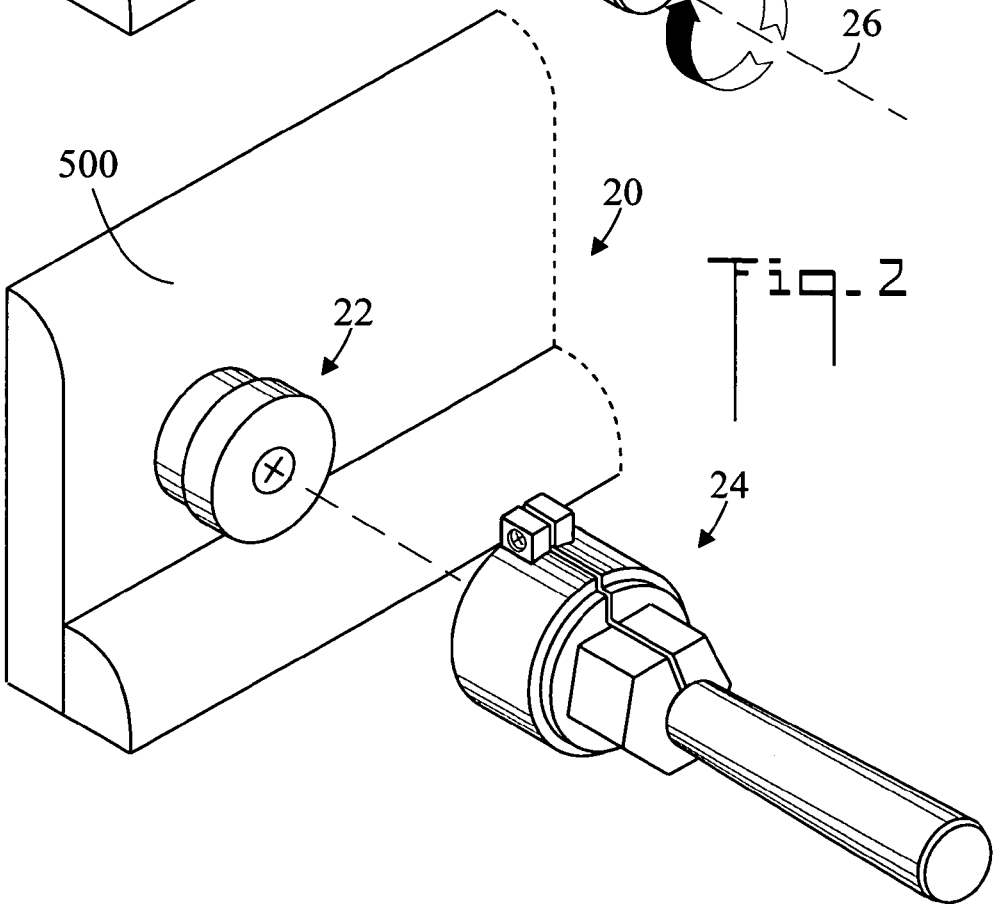
FIG. 2 is an exploded perspective view of the door stop.

Referring initially to FIGS. 1 and 2, there are illustrated perspective and exploded perspective views respectively of a door stop 20 in accordance with the present invention installed on a baseboard 500 or other structure. Door stop 20 includes a base member 22 and a stop member 24 having a longitudinal axis 26. Stop member 24 is connected to base member 22 so that stop member 24 may freely rotate with respect to base member 22 in either direction about longitudinal axis 26.

Now referring to FIGS. 3–6, there are illustrated top plan, side elevation, end elevation, and opposite end elevation views respectively of stop member 24. Elongated stop member 24 has a cavity 28 (also refer to FIG. 13) which is shaped and dimensioned to receive a disk 30 of base member 22 (refer also to FIGS. 7–8), wherein when so received stop member 24 may freely rotate about its longitudinal axis 26. Stop member 24 also has a substantially circular lip 32 (also refer to FIG. 13) for selectively capturing disk 30. Stop member 24 also has a compression mechanism 34 for selectively placing lip 32 in an expanded state (refer to FIG. 5) or a compressed state (refer to FIG. 12). With lip 32 in the expanded state disk 30 may be passed though lip 32 and received by cavity 28, and compression mechanism 34 may then be utilized to place lip 32 in the compressed state wherein disk 30 is captured by lip 30 and held within cavity 28 thereby rotatably connecting stop member 24 to said base member 22 (refer to FIG. 13). End 25 of stop member 24 comes in contact with the opening door.

In an embodiment of the invention, compression mechanism 34 includes a sleeve 36 which forms cavity 28 and lip 32, sleeve 36 having a slot 38. First 40 and second 42 bosses are disposed on sleeve 36 on opposite sides of slot 38. A recessed adjustment screw 44 connects first 40 and second 42 bosses, wherein by turning adjustment screw 44 the bosses may be brought closer together or moved further apart. That is, adjustment screw 44 may be used to alter the diameter of lip 32 by changing the width of slot 38 (refer also to FIG. 12). When lip 32 is in the expanded state it has a first diameter D1 (refer to FIG. 4). When lip 32 is in the compressed state it has a second diameter D2 which is less than first diameter D1 (refer to FIG. 12). Disk 30 (refer to FIG. 9) has a third diameter D3 which is (1) less than first diameter D1 so that disk 30 may enter cavity 28 when lip 32 is in the expanded state, and (2) greater than second diameter D2 so that when disk 30 resides within cavity 28 and lip 32 is placed in the compressed state disk 30 is retained within cavity 28 by lip 32 (refer to FIG. 13).

FIGS. 7–9 are side elevation, end elevation, and opposite end elevation views respectively of base member 22. Base member includes disk 30, shank 31, and a mounting screw 33 for attaching base member 22 to a baseboard 500 (refer to FIG. 10).

FIG. 10 is a side elevation view of base member 22 installed on a baseboard 500. Mounting screw 33 is used to effect the installation. In this embodiment, disk 30 and shank 31 are attached to baseboard 500 by screw 33 so that disk 30 and shank 31 will not rotate about screw 33.

FIG. 11 is a side elevation view of stop member 24 installed on base member 22. In this view, disk 30 (refer to FIG. 10) has been received by cavity 28 and lip 32 has been placed in the compressed state by compression mechanism 34 so that stop member 24 is rotatably connected to base member 22. It is noted that a gap G exist between stop member 24 and baseboard 500 so that stop member 24 will not contact baseboard 500 and is therefore free to rotate with respect to base member 22 about longitudinal axis 26.

FIG. 12 is a cross sectional view along the line 12—12 of FIG. 11 showing lip 32 placed in the compressed state by adjustment screw 44. That is bosses 40 and 42 have been moved together by adjustment screw 44 there reducing the diameter D2 of lip 32.

FIG. 13 is a partial cross sectional view showing how base member 22 is rotationally received by the stop member 24. Disk 30 is inside cavity 28 and lip 32 has been placed in the compressed state thereby holding disk 30 within cavity 28.

FIG. 14 is an exploded side elevation view of a second embodiment of the door stop generally designated as 120. In this embodiment a sleeve 70 connects base member 122 to stop member 124. Sleeve 70 has cavities 151 and 152 which receive disk 130 of base member 122 and disk 150 of stop member 124 respectively in a manner similar to embodiment 20.

Figure 15:
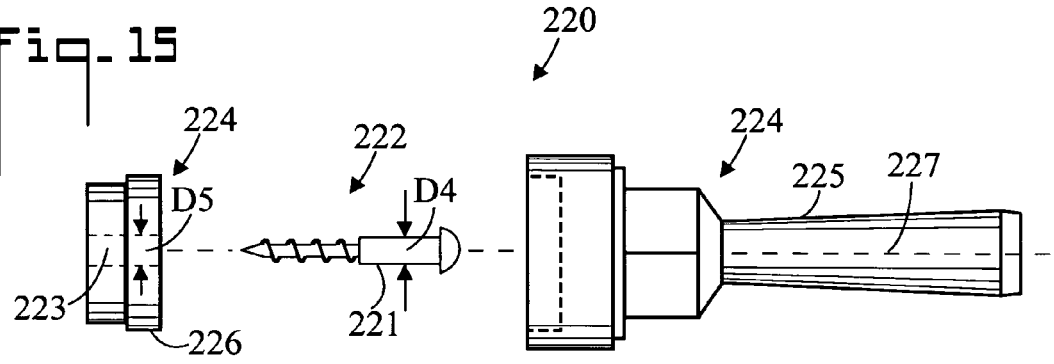
FIG. 15 is an exploded side elevation view of a third embodiment of the door stop; and, FIG. 16 is a side elevation view of the third embodiment installed on a baseboard.
Figure 16:
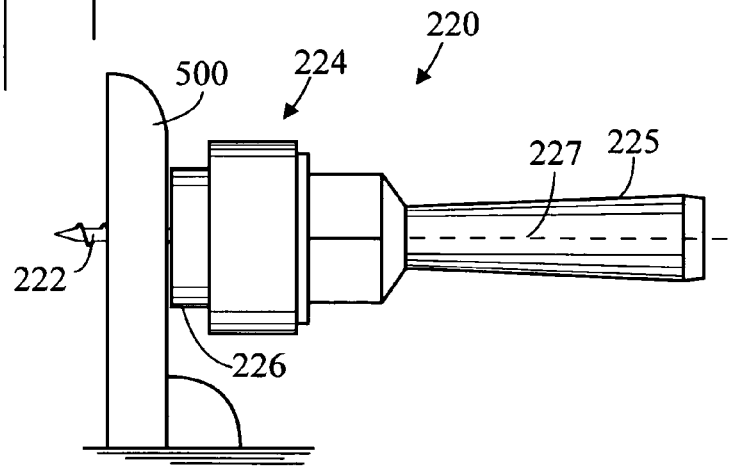

FIG. 15 is and exploded side elevation view of a third embodiment of the door stop generally designated as 220, and FIG. 16 is a side elevation view of door stop 220 installed on a baseboard 500. This embodiment includes a base member 222 having a shank portion 221 having a first diameter D4. In the shown embodiment, base member 222 is a screw. Stop 220 further includes a stop member 224. Stop member 224 includes a door stop portion 225 and a rotational portion 226. Rotational portion 226 has a through hole 223 having a second diameter D5 which is greater than first diameter D4. Rotational portion 226 is attached to baseboard 500 by base member 222 so that rotational portion 226 is rotatable about shank portion 221 of base member 222. Door stop portion 225 may then be fixedly connected to rotational portion 226 so that stop member 224 may freely rotate with respect to base member 222 about longitudinal axis 227. In the shown embodiment door stop portion 225 is press fit onto rotational portion 226, however the clamping mechanism of embodiments 20 and 120 could also be utilized.

In terms of use, a method for installing a door stop, includes:

(a) providing a baseboard 500;
(b) providing a door stop 20 including:
  a base member 22 having a disk 30;
  a stop member 24 having:
    a longitudinal axis 26;
    a cavity 28 shaped and dimensioned to receive disk 30 of base member 22, wherein when so received stop member 24 may freely rotate about longitudinal axis 26;
    a lip 32 for selectively capturing disk 30;
    a compression mechanism 34 for selectively placing lip 32 in an expanded state or a compressed state;
(c) attaching base member 22 to baseboard 500;
(d) placing lip 32 in the expanded state;
(e) passing disk 30 through lip 32 and into cavity 28; and,
(f) using compression mechanism 34 to place lip 32 in compressed state wherein disk 30 is captured by lip 32, wherein stop member 24 is rotatably connected to base member 22.

The method further including:

in step (b), when in the expanded state lip 32 having a first diameter D1;

when in the compressed state lip 32 having a second diameter D2 less than first diameter D1; and, disk 30 having a third diameter D3, wherein third diameter D3 is less than first diameter D1 and greater than second diameter D2.

The method further including:

in step (b), compression mechanism 34 including:
  a sleeve 36 forming cavity 28 and lip 32, sleeve 36 having a slot 38;
  first 40 and second 42 bosses disposed on sleeve 36 on opposite sides of slot 38; and,
  an adjustment screw 44 connecting first 40 and second 42 bosses, wherein by turning adjustment screw 44 the bosses may be brought closer together or further apart.

The method further including:

in step (b), base member 22 including a mounting screw 33 for attaching base member 22 to baseboard 500 in step (c).

The method further including:

after step (f), when stop member 24 is connected to base member 22, a gap G existing between stop member 24 and baseboard 500.

A second method for installing a door stop, includes:

(a) providing a baseboard 500;
(b) providing a door stop 220 including:
  a base member 222 having a shank portion 221;
  a stop member 224 having:
    a longitudinal axis 227;
    a door stop portion 225;
    a rotational portion 226 having a through hole 223 to accept base member 222;
(c) attaching base member 222 to baseboard 500 so that rotational portion 226 is rotatable about shank portion 221 of base member 222; and,
(d) connecting door stop portion 225 to rotational portion 226 so that stop member 224 freely rotates with respect to base member 222 about longitudinal axis 227.

The preferred embodiments of the invention described herein are exemplary and numerous modifications, variations, and rearrangements can be readily envisioned to achieve an equivalent result, all of which are intended to be embraced within the scope of the appended claims.

I claim:

1. A door stop, comprising:

a base member;

a stop member having a longitudinal axis;

said stop member connected to said base member so that said stop member may freely rotate with respect to said base member about said longitudinal axis:

said base member having a disk;

said stop member having:

a cavity shaped and dimensioned to receive said disk of said base member;

a lip for selectively capturing said disk;

a compression mechanism for selectively placing said lip in an expanded state or a compressed state; and, wherein with said lip in said expanded state said disk may be passed though said lip and received by said cavity, and said compression mechanism may then be utilized to place said lip in said compressed state wherein said disk is captured by said lip and held within said cavity thereby rotatably connecting said stop member to said base member.

2. The door stop according to claim 1, further including:

when in said expanded state said lip having a first diameter;

when in said compressed state said lip having a second diameter less than said first diameter; and, said disk having a third diameter, wherein said third diameter is less than said first diameter and greater than said second diameter.

3. The door stop according to claim 1, further including:

said compression mechanism including:

a sleeve forming said cavity and said lip, said sleeve having a slot;

first and second bosses disposed on said sleeve on opposite sides of said slot; and, an adjustment screw connecting said first and second bosses, wherein by turning said adjustment screw said bosses may be brought closer together or further apart.

4. The door stop according to claim 1, further including:

said base member including a mounting screw for attaching said base member to a baseboard.

5. The door stop according to claim 4, further including:

when said stop member is connected to said base member, a gap existing between said stop member and the baseboard.

6. The door stop according to claim 1, further including:

when in said expanded state said lip having a first diameter;

when in said compressed state said lip having a second diameter less than said first diameter;

said disk having a third diameter, wherein said third diameter is less than said first diameter and greater than said second diameter;

said compression mechanism including:

a sleeve having a slot forming said cavity and said lip;

first and second bosses disposed on said sleeve on opposite sides of said slot; and, an adjustment screw connecting said first and second bosses, wherein by turning said adjustment screw said bosses may be brought closer together or further apart;

said base member including a mounting screw for attaching said base member to a baseboard; and, when said stop member is connected to said base member, a gap existing between said stop member and the baseboard.

7. A door stop, comprising:

a base member having a disk;

a stop member having:

a longitudinal axis;

a cavity shaped and dimensioned to receive said disk of said base member, wherein when so received said stop member may freely rotate about said longitudinal axis;

a lip for selectively capturing said disk;

a compression mechanism for selectively placing said lip in an expanded state or a compressed state; and, wherein with said lip in said expanded state said disk may be passed though said lip and received by said cavity, and said compression mechanism may then be utilized to place said lip in said compressed state wherein said disk is captured by said lip and held within said cavity thereby rotatably connecting said stop member to said base member.

8. The door stop according to claim 7, further including:

when in said expanded state said lip having a first diameter;

when in said compressed state said lip having a second diameter less than said first diameter; and, said disk having a third diameter, wherein said third diameter is less than said first diameter and greater than said second diameter.

9. The door stop according to claim 7, further including:

said compression mechanism including:

a sleeve forming said cavity and said lip, said sleeve having a slot;

first and second bosses disposed on said sleeve on opposite sides of said slot; and, an adjustment screw connecting said first and second bosses, wherein by turning said adjustment screw said bosses may be brought closer together or further apart.

10. The door stop according to claim 7, further including:

said base member including a mounting screw for attaching said base member to a baseboard.

11. The door stop according to claim 7, further including:

when said stop member is connected to said base member, a gap existing between said stop member and the baseboard.

12. The door stop according to claim 7, further including:

when in said expanded state said lip having a first diameter;

when in said compressed state said lip having a second diameter less than said first diameter;

said disk having a third diameter, wherein said third diameter is less than said first diameter and greater than said second diameter;

said compression mechanism including:

a sleeve forming said cavity and said lip, said sleeve having a slot;

first and second bosses disposed on said sleeve on opposite sides of said slot;

an adjustment screw connecting said first and second bosses, wherein by turning said adjustment screw said bosses may be brought closer together or further apart;

said base member including a mounting screw for attaching said base member to a baseboard; and, when said stop member is connected to said base member, a gap existing between said stop member and the baseboard.

13. A method for installing a door stop, comprising:

(a) providing a baseboard;

(b) providing a door stop including:

a base member having a disk;

a stop member having:

a longitudinal axis;

a cavity shaped and dimensioned to receive said disk of said base member, wherein when so received said stop member may freely rotate about said longitudinal axis;

a lip for selectively capturing said disk;

a compression mechanism for selectively placing said lip in an expanded state or a compressed state;

(c) attaching said base member to said baseboard;

(d) placing said lip in said expanded state;

(e) passing said disk through said lip and into said cavity; and, (f) using said compression mechanism to place said lip in said compressed state wherein said disk is captured by said lip, wherein said stop member is rotatably connected to said base member.

14. The method of claim 13, further including:

in step (b), when in said expanded state said lip having a first diameter;

when in said compressed state said lip having a second diameter less than said first diameter; and, said disk having a third diameter, wherein said third diameter is less than said first diameter and greater than said second diameter.

15. The method of claim 13, further including:

in step (b), said compression mechanism including:

a sleeve forming said cavity and said lip, said sleeve having a slot;

first and second bosses disposed on said sleeve on opposite sides of said slot; and, an adjustment screw connecting said first and second bosses, wherein by turning said adjustment screw said bosses may be brought closer together or further apart.

16. The method of claim 13, further including:

in step (b), said base member including a mounting screw for attaching said base member to said baseboard in step (c).

17. The method of claim 13, further including:

after step (f), when said stop member is connected to said base member, a gap existing between said stop member and said baseboard.

* * * * *